US005211161A

United States Patent [19]

Stef

[11] Patent Number: 5,211,161

[45] Date of Patent: May 18, 1993

[54] THREE AXIS PASSIVE MOTION EXERCISER

[75] Inventor: Francine Stef, Charleville Mezieres, France

[73] Assignee: Compagnie Generale De Materiel Orthopedique, Tournes, France

[21] Appl. No.: 643,566

[22] Filed: Jan. 22, 1991

[51] Int. Cl.[5] ..... A61H 1/02

[52] U.S. Cl. ..... 128/25 B; 128/25 R

[58] Field of Search ..... 128/25 B, 25 R; 482/79, 482/80, 900, 901, 902, 903, 9, 92; 36/142, 143, 144; 73/379

[56] References Cited

U.S. PATENT DOCUMENTS

| | | | |
|---|---|---|---|
| 2,206,902 | 7/1940 | Kost . | |
| 3,060,926 | 10/1962 | May . | |
| 3,450,132 | 6/1969 | Ragon et al. . | |
| 4,235,437 | 11/1980 | Ruis et al. . | |
| 4,650,183 | 3/1987 | McIntyre | 272/96 |
| 4,653,479 | 3/1987 | Maurer | 128/25 B |
| 4,691,694 | 9/1987 | Boyd et al. | 128/25 R |
| 4,727,860 | 3/1988 | McIntyre | 128/25 R |
| 4,807,601 | 2/1989 | Wright | 128/25 R |
| 4,889,108 | 12/1989 | Bond et al. | 128/25 R |
| 4,893,808 | 1/1990 | McIntyre et al. | 272/94 |
| 4,934,694 | 6/1990 | McIntosh | 272/129 |
| 5,049,079 | 9/1991 | Furtado et al. | 434/253 |

FOREIGN PATENT DOCUMENTS

| | | |
|---|---|---|
| 2635457 | 2/1990 | France . |
| WO90/00383 | 1/1990 | PCT Int'l Appl. . |
| WO90/11750 | 10/1990 | PCT Int'l Appl. . |

*Primary Examiner*—Richard J. Apley
*Assistant Examiner*—John P. Leubecker
*Attorney, Agent, or Firm*—Pravel, Hewitt, Kimball & Krieger

[57] ABSTRACT

A three axis passive motion exerciser which moves the patient's foot in dorsal/plantar, valgus/varus and abduction/adduction movements. A microprocessor provides signals to control motors which drive cradles and a plate in the desired motions. Potentiometers provide positional feedback information about the actual location of the cradles and the plate, with series resistors providing feedback of the actual motor drive current values. The microprocessor monitors the positions of two motions versus a master motion to keep the movements in synchronization. The movements are synchronized so that the end of the travel limit is reached for each axis simultaneously. The microprocessor further monitors the drive currents to prevent overcurrent conditions and the speeds to limit travel rates. A display and keyboard are provided to allow the operator to monitor and change operating parameters, such as travel limits, force limits and session times.

20 Claims, 11 Drawing Sheets

THREE AXIS PASSIVE MOTION EXERCISER

BACKGROUND OF THE INVENTION

1. Field of the Invention

The invention generally relates to continuous passive motion exercise equipment, and more specifically to a multiple axis exerciser used for moving the foot.

2. Description of the Related Art

Continuous passive motion of joints for therapeutic reasons is an area undergoing growth. By passively moving the desired joint when the patient is not capable, joint, ligament and muscle degradation is reduced while the patient is recovering sufficiently to allow him to perform the exercises on his own volition. Continuous passive motion generally is a gentle cyclic motion of the particular joint along its natural axes. Various devices are well known for doing this, many being related to the hip, knee and a single axis of the ankle. Other devices are available for shoulders, elbows and the fingers of the hand.

One complicating factor to development of devices for several joints such as the ankle, hip or shoulder is that these are joints that can move in a large number of axes. Unlike the elbow and the knee, which are effectively only single axis or pinned joints, the ankle, hip and shoulder can move in three independent axes, at least within certain movement ranges. This greatly complicates exerciser design if adjustments for the various axes are to be determined. Typically this has been resolved by using separate machines for the separate motions or axes, thus not allowing concurrent motions of the various axes.

One area where multiple axis continuous passive motion is desirable is in the treatment of hind or club feet in infants. Many infants are born with their feet in a hind or curled position and having relatively limited movement. One prior technique for helping to correct this situation required a therapist on a periodic basis to use large amounts of force to attempt to stretch the various ligaments, tendons and other elements in the ankle which were causing the condition. This was quite painful to the child because of the great forces used and great stresses developed. Additionally, access to a trained therapist was required on a frequent basis, thus increasing expenses and being very inconvenient.

A second alternative was a surgical technique. The necessary elements were severed and lengthened so that various portions could be reattached in a more natural location and proper movement of the foot could be obtained. This was quite complicated and often resulted in the foot being immobile for long periods of time while any healing or mending took place. Additionally, it was a surgical procedure on an infant with all the resultant problems and concerns. Quite often the combination of the two techniques was utilized, further increasing costs and difficulties.

SUMMARY OF THE INVENTION

The multiple axis hind foot exerciser according to the present invention uses a microprocessor and a series of three motors to control movement of the foot about the ankle in three different axes. The movements are continuous and passive and can be performed for a long duration, exerting relatively minor forces on the various elements in the ankle. The various motions are interrelated and the total travels can be progressively increased in successive treatment sessions. By having the treatment sessions last for long periods of time, the large amounts of force necessary by the previous manual techniques are not required, thus allowing the various items to stretch more naturally and slowly to the desired state.

The microprocessor controls both the position and torque of the three motors so that not only movement speed of the various motions but also the relationships between the various motions are maintained so that grossly improper movements of the ankle are not developed. The microprocessor provides a desired drive signal which is converted to an analog signal, which in turn is provided to the motor. The drive current of the motor is sensed and provided to the microprocessor to allow torque based corrections. Additionally, the actual position in each axis is developed by a potentiometer for each axis. In this manner speed tracking and position tracking can be performed by the microprocessor to keep the various motions in the three axes in synchronization with each other.

The various forces which can be utilized can be programmed, for each direction of travel, while the entire exercise interval or therapeutic session time length can be set. Further, the amount of rotation of the desired primary motion can be set and altered, allowing progressive therapy. Use of the microprocessor and an external computer allows various patient tracking and data recording so that historical trends can be developed to see progress of the patient.

BRIEF DESCRIPTION OF THE DRAWINGS

A better understanding of the present invention can be had when the following detailed description of the preferred embodiment is considered in conjunction with the following drawings in which.

DETAILED DESCRIPTION OF THE PREFERRED EMBODIMENT

Figure 1:
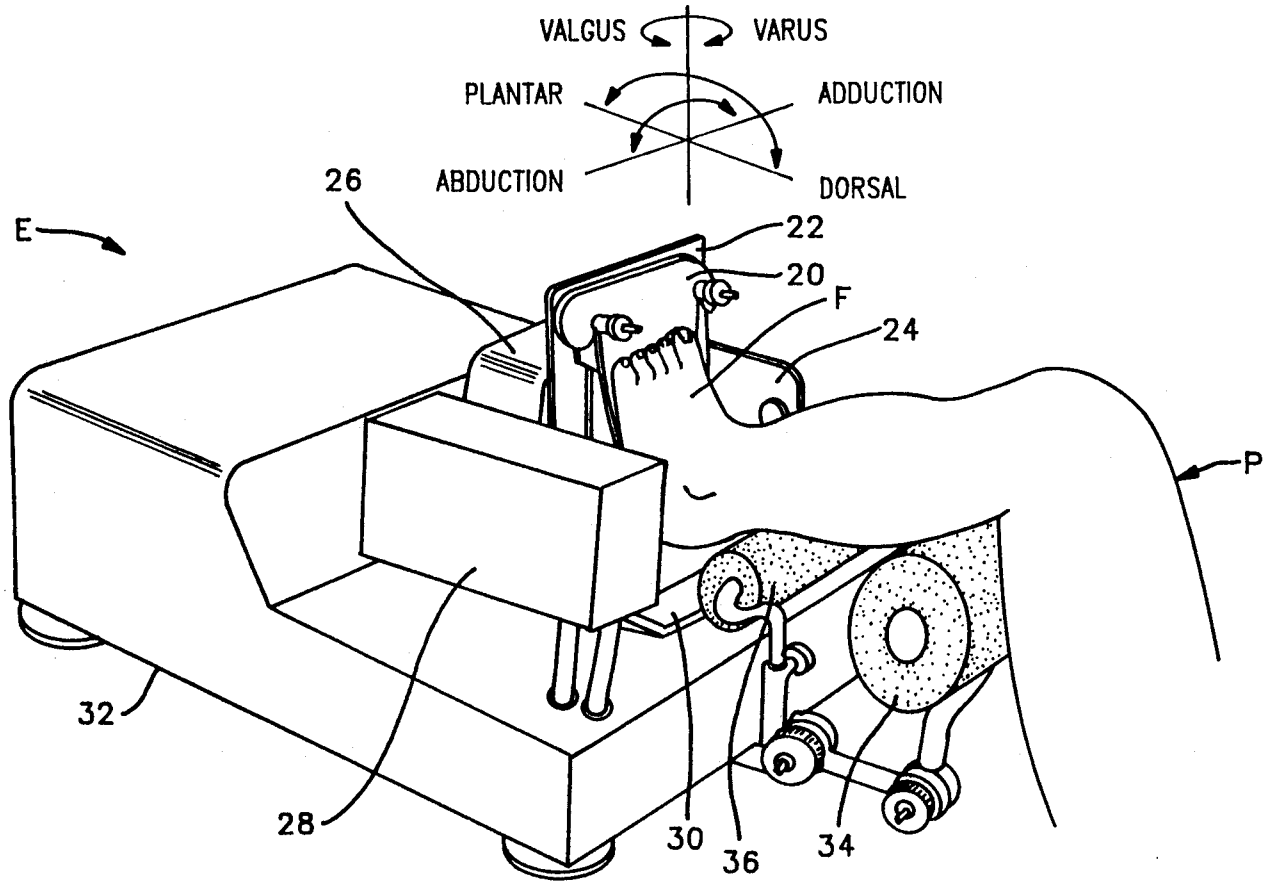
FIG. 1 is a perspective view of an exerciser according to the present invention.

Referring now to FIG. 1, the letter E generally represents a three axis passive motion exerciser according to the present invention. The FIGURE illustrates the location of a patient P with respect to the exerciser E. The foot F of the patient P is firmly attached to a sole plate 20. The sole plate 20 is preferably attached via a coil spring mechanism (not shown) to an attachment plate 22. The attachment plate 22 is connected to a first cradle 24, the cradle 24 preferably being U-shaped. The cradle 24 has attached an abduction/adduction motor housing 26. A motor contained in this housing 26 is used to develop an abduction/adduction motion of the foot F by rotating the attachment plate 22 between positive and negative limits. The cradle 24 is coupled to a motor contained in a plantar/dorsal motor housing 28. The motor contained in this housing 28 causes the cradle 24 to move in a plantar/dorsal direction as indicated in the reference axes illustration shown in FIG. 1. The housing 28 is attached to a lower cradle 30, which projects through an outer housing 32 of the exerciser E. The outer housing 32 is used to cover the various electronic portions used to control the operation of the exerciser E and the motor used to move the cradle 30 in a valgus/-varus direction.

Preferably the patient's leg is supported on several supports 34 and 36 to provide a comfortable position and to securely locate the leg at the desired pivot points. The pivot points of the attachment plate 22, the upper cradle 24 and the lower cradle 30 are designed to coincide generally with the movement center of the ankle of the patient. This allows free movement of the foot F in its natural directions without developing additional resistance or potentially damaging other portions of the foot and ankle.

Figure 2:
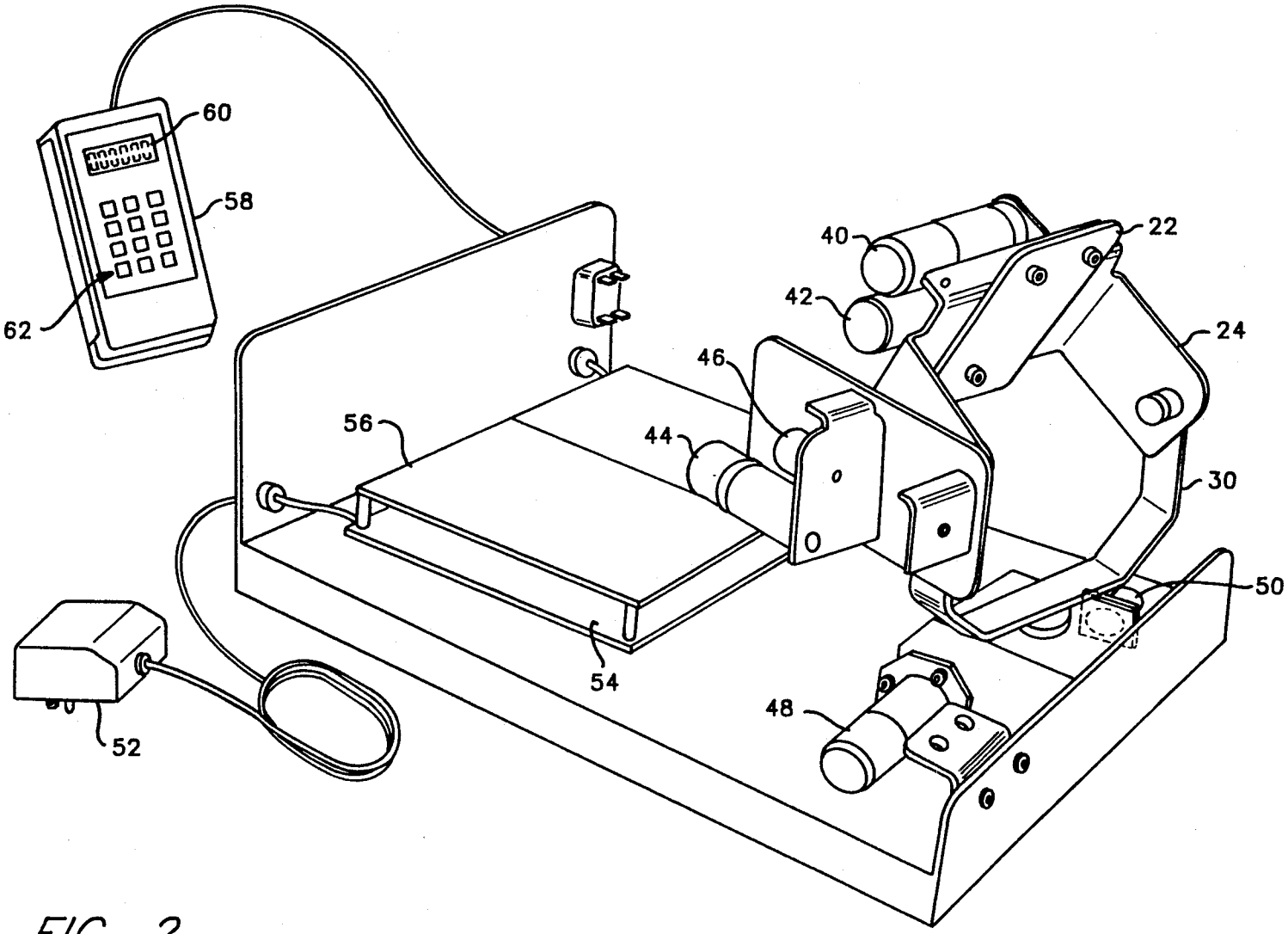
FIG. 2 is a perspective view of portions of the main internal elements of the exerciser of FIG. 1.

The various cradles and axes of movement can be better seen in FIG. 2. As can be seen, the attachment plate 22 is rotatably connected to the upper cradle 24 and is connected to a motor 40 through a drive train which causes the attachment plate 22 to pivot. A potentiometer 42 is coupled to the attachment plate 22 so that an accurate determination of the rotation of the attachment plate 22 can be determined for feedback purposes.

The upper cradle 24 is caused to move in the plantar/dorsal direction by means of a motor 44 with associated drive train, with feedback being developed by a potentiometer 46. A motor 48 and associated drive train provides the driving force for the lower cradle 30, to cause it to move in the valgus/varus direction, while a potentiometer 50 is used for position feedback. A power supply 52 is connected into a suitable source of electrical power and provides energy to electronic circuit boards 54 and 56 in the preferred embodiment. These electronic circuit boards 54 and 56 contain the necessary control and drive circuitry used to allow the exerciser E to function. A hand held terminal 58, which preferably includes a display 60 and a keyboard 62, is connected to the electronic circuit boards 54 and 56.

Figure 3:
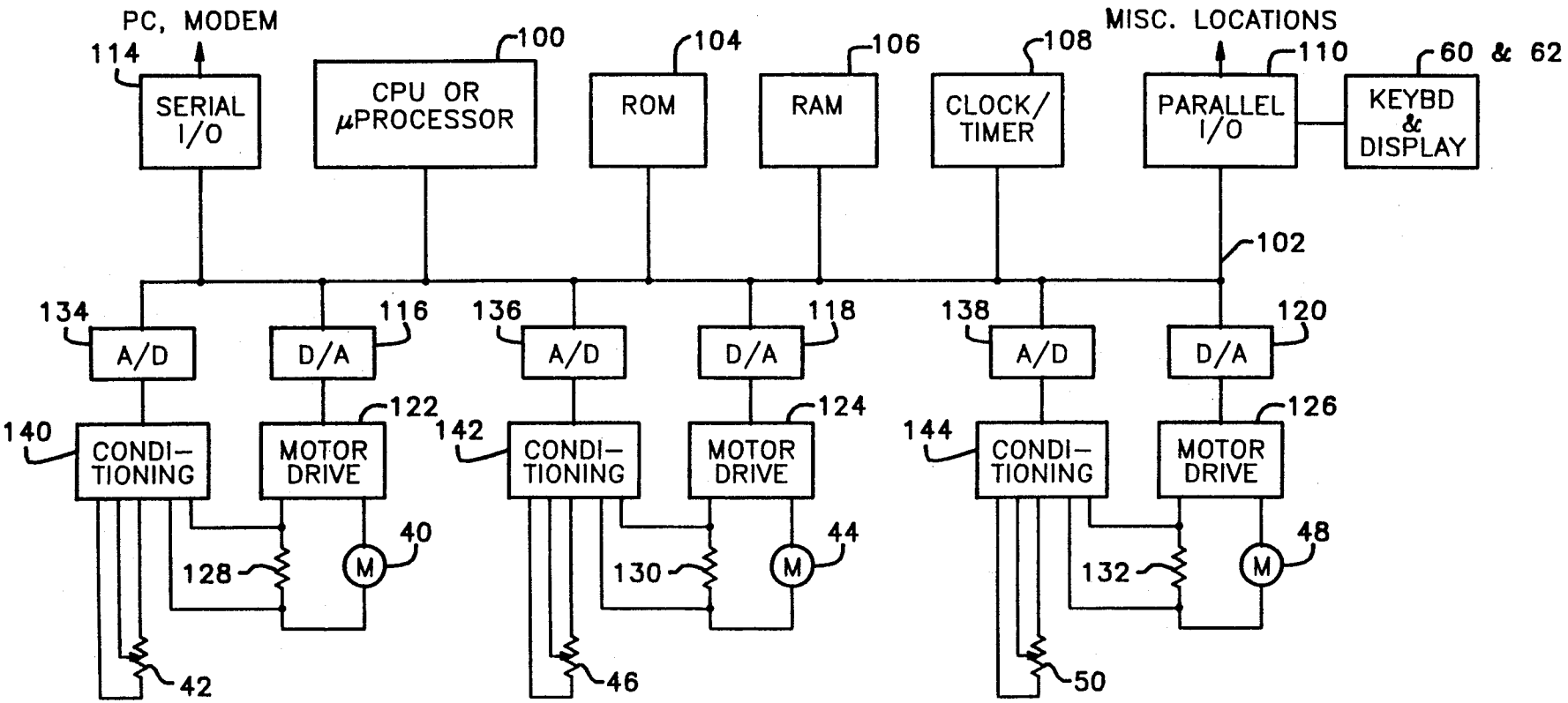
FIG. 3 is a block diagram of the electronic circuitry of the exerciser of FIG. 1.

The block diagram of the electronic circuitry of the exerciser E is shown in FIG. 3. A microprocessor or CPU 100 is the processing element of the electronics. Preferably the microprocessor 100 is a Z80 developed by Zilog Corporation and produced by a series of manufacturers. The microprocessor 100 is coupled to a bus 102 over which address, data and control information is communicated. Read only memory (ROM) 104 and random access memory (RAM) 106 are connected to the bus 102 for use by the microprocessor 100. The ROM 104 stores the operating instructions of the microprocessor 100, while the RAM 106 provides temporary storage for desired parameters. Preferably the RAM 106 contains a non-volatile portion to allow operating parameters to be stored while the exerciser E is turned off. A clock/timing unit 108 is connected to the bus 102 to provide interrupts to the microprocessor 100 at desired intervals and to allow other timing events as necessary. Parallel input/output (I/O) circuitry 110 is coupled to the bus 102 to allow the microprocessor 100 to perform certain I/O operations. The parallel I/O circuitry 110 is coupled to the keyboard 62 and display 60 of the terminal 58 so that the microprocessor 100 can scan the keyboard 62 and provide information to the display 60. Additionally, the parallel I/O circuitry 110 is connected to various locations on the circuitry to provide control outputs and feedback inputs as necessary. A serial I/O circuitry block 114 is connected to the bus 102. The serial I/O block 114 serves as an interface between an external personal computer or modem and the microprocessor 100 to allow external control and transmission of data from the exerciser E to the external unit for database development and patient information tracking.

A series of three digital/analog (D/A) convertors 116, 118 and 120 are connected to the bus 102. The analog outputs of the D/A convertors 116, 118 and 120 are connected, respectively, to motor drive circuits 122, 124 and 126. The motor drive circuits 122, 124 and 126 react to the analog level of the signal produced by the D/A convertor 116, 118 or 120 to produce a signal to drive the associated motor 40, 44 or 48 at the speed or torque as requested by the microprocessor 100. A current sense resistor 128, 130 and 132 is located in each loop to the motors 40, 44 and 48 so that one terminal of the resistor 128, 130 or 132 and one terminal of the motor 40, 44 or 48 are connected to the motor drive circuits 122, 124 and 126. The current sense resistors 128, 130 and 132 are used to monitor the amount of current being utilized by the motors 40, 44 and 48 for feedback purposes so that should the motor reach a high current state, indicating a high resistance to movement so that the direction can be reversed, or for general torque measurement and monitoring.

A series of three analog/digital (A/D) convertors 134, 136 and 138 are connected to the bus 102 to allow retrieval of digital information by the microprocessor 100. Preferably the A/D convertors 134, 136 and 138 are adapted to receive at least two input analog channels. Conditioning circuitry 140, 142 and 144 is connected to the A/D convertors 134, 136 and 138, respectively. The conditioning circuitry 140, 142 and 144 has inputs connected across the feedback resistors 128, 130 and 132 to allow monitoring of the actual currents in the motors 40, 44 and 48. This feedback voltage preferably is one input to the A/D convertor 134, 136 and 138. The second analog input is provided by the feedback resistors 42, 46 and 50. The two end terminals and wiper arm of the potentiometers 42, 46 and 50 are connected to the conditioning circuits 140, 142 and 144 respectively, so that monitoring of the actual position of the attachment plate 22, the upper cradle 24 and the lower cradle 30 can be developed. As the cradles move, the position of the wipers on the potentiometers 42, 46 and 50 moves, so that the feedback voltages indicate the actual position of the various elements.

Thus the microprocessor 100 can control the motor drive speed and/or torque by use of the D/A convertors 116, 118 and 120 by setting an appropriate digital value and can then use the A/D convertors 134, 136 and 138 to monitor the actual current being utilized via the sense resistors 128, 130 and 132 and the actual position via the potentiometers 42, 46 and 50. With this output control and feedback information available, the microprocessor 100 can carefully and accurately control the various motions of the foot F so that the proper relationships and movements of the ankles are developed at all times. By properly programming the microprocessor operations, undesirable positioning of the foot F can be reduced to acceptable levels.

Figure 4:
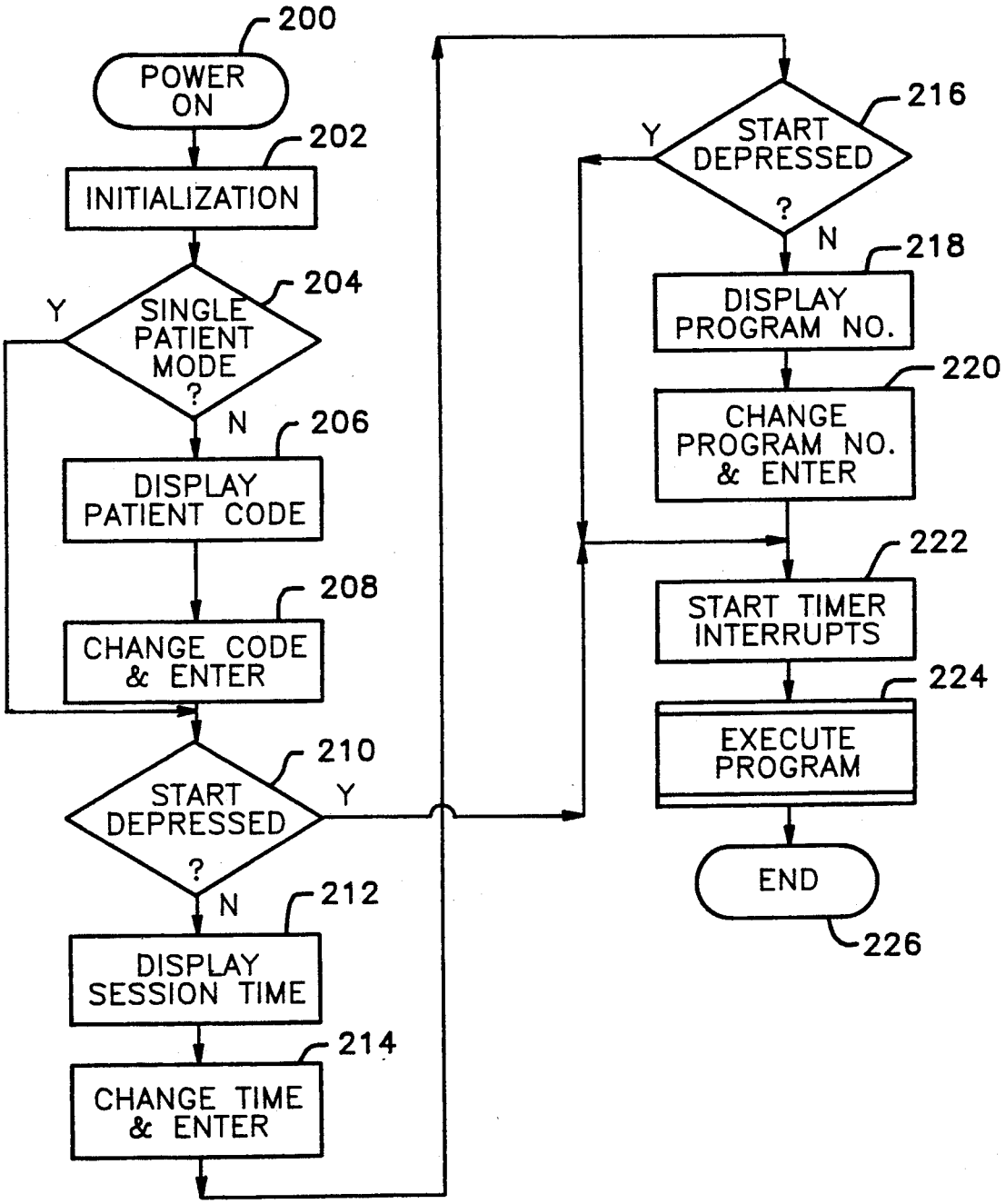
FIGS. 4, 5, 6A, 6B, 7A, 7B, 7C and 7D are flow chart illustrations of operating sequences of the exerciser of FIG. 1.

As the microprocessor 100 is utilized to control the exerciser E, various operating sequences are necessary. FIG. 4 is a flow chart of the highest level of operation. The power-on sequence 200 commences at step 202 where various initialization events occur. Typically these are diagnostics of the various elements in the exerciser E, as well as setting and clearing of the particular timer registers and data values necessary for operation. Control proceeds to step 204 to determine if the exerciser E is to be operating in single patient mode. Preferably this is set by a jumper located on the electronic circuitry and is changed according to the particular operating environment of the specific exerciser E. If the exerciser E is not operating in single patient mode, control proceeds to step 206 where the particular patient code is displayed on the display 60. The desired patient code value is then provided using the display 60 and the keyboard 62 and this patient code is then entered in step 208. Control then proceeds to step 210. Step 210 is also where control proceeds if the exerciser E is used in single patient mode as determined in step 204.

In step 210 the microprocessor 100 determines whether the start key on the key board 62 has been depressed. Preferably, the keyboard 62 includes start and stop keys, increment and decrement keys, an enter key, a time key, a mode key and keys representing the three movement axes. If the start key has not been depressed, control proceeds to step 212 where the session time is displayed. The session time is preferably the length of the exercise session, which in the preferred embodiment for the hind foot passive motion exerciser, is a long period, preferably even an overnight or 24 hour period. Control then proceeds to step 214 where the time is changed if desired and the time value is entered. Control then proceeds to step 216 to determine if the start key was depressed at this time. If not, control proceeds to step 218 to display the program number. Preferably the exerciser E can perform a number of different programs for each user to allow a variable number of axes or motions to be controlled with different force rates and amounts of movement. These are generally referred to by the program number, which can be changed in step 220. After step 220, control proceeds to step 222. Step 222 is also where control proceeds if the start key had been depressed in step 210 or step 216.

In step 222 the timer interrupts are activated so that operation of the exerciser E can commence. Because the exerciser E is a real time device, the operating system is configured such that at periodic intervals the session timer is decreased and the keyboard 62 is scanned to determine if the operator is requesting information or desires to stop or change the program. After the timer interrupts are enabled, control proceeds to step 224 where the actual exercise program is executed. Control would then proceed to step 226 to terminate operations after the session is completed.

Figure 5:
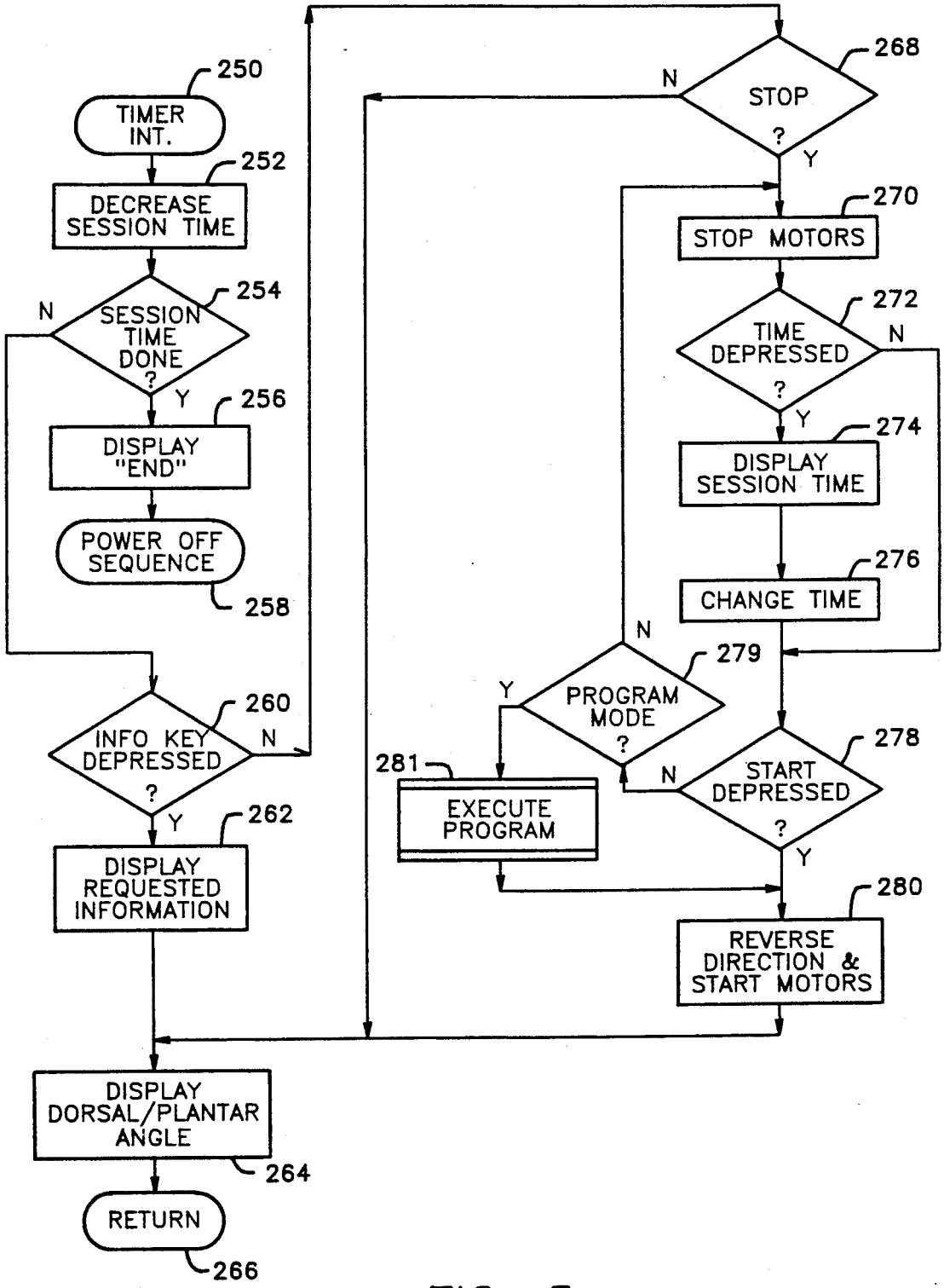

It is noted that the timer 108 is set up to periodically interrupt the microprocessor 100 to both time the session and to monitor operation of the keyboard 62. The timer interrupt sequence 250 (FIG. 5) commences at step 252 where the session time is decreased by the timer interval value. Control proceeds to step 254 to determine if the session is completed. If so, control proceeds to step 256 where the word "end" is displayed on the terminal T. Control then proceeds to step 258 which is the power off sequence which terminates the active operation of the exerciser E and then to step 226.

If the session was not completed, control proceeds to step 260 where a determination is made as to whether an information key has been depressed. The information key, is preferably the varus/valgus, the dorsal/plantar, the abduction/adduction and other similar keys. Control proceeds to step 262 where the information requested is displayed. Control then proceeds to step 264 after a certain interval where the dorsal/plantar angle is displayed. Preferably the dorsal/plantar angle is continuously displayed to show the actual movement of the device to allow monitoring of the travel. Control then returns to the interrupted sequence in step 266.

Figure 6A:
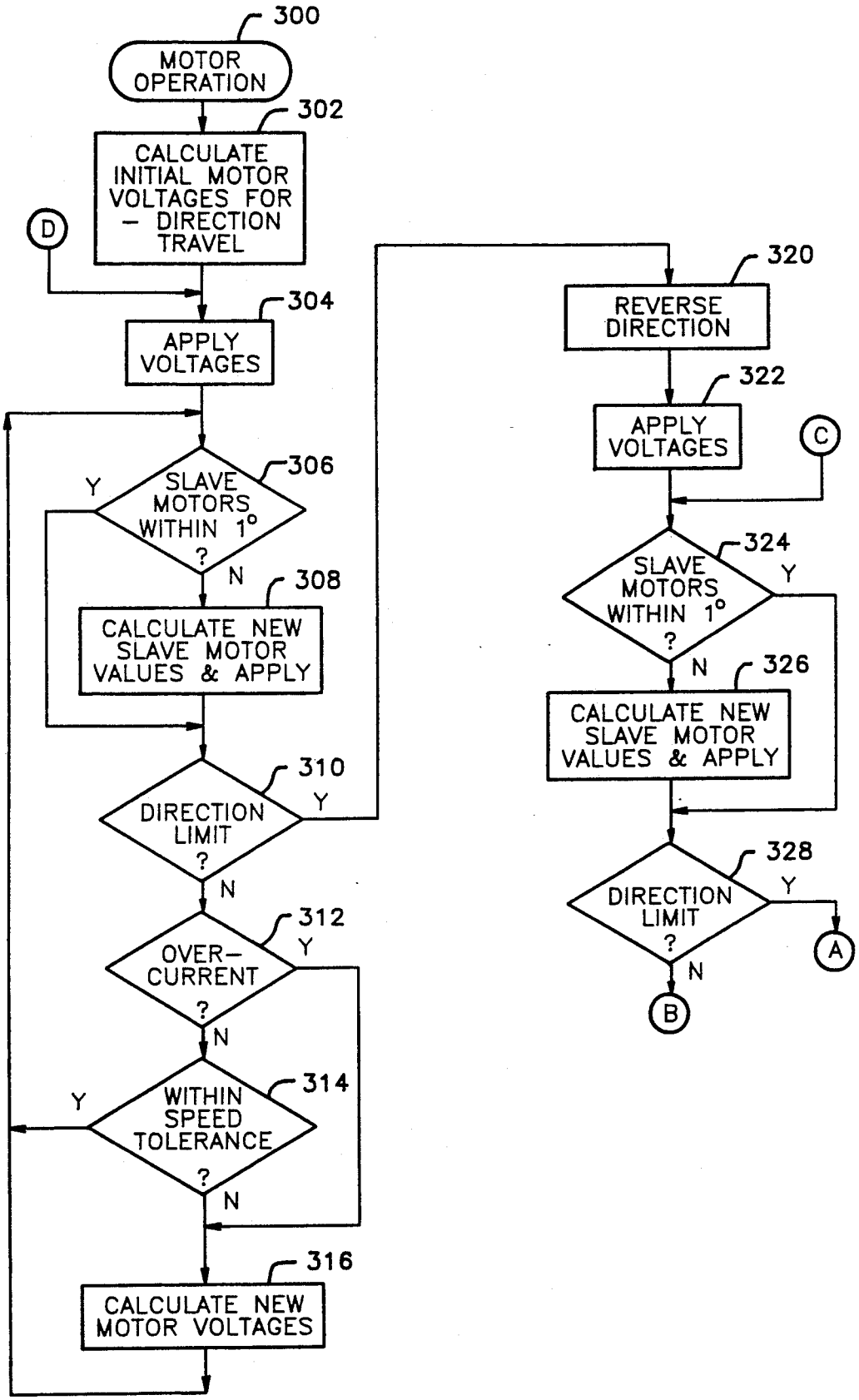

If in step 260 it was determined that an information key was not depressed, control proceeds to step 268 to determine if the stop key had been depressed. If not, control proceeds to step 264. If so, control proceeds to step 270 where the motors 40, 44 and 48 are stopped. Control then proceeds to step 272 to determine if the time key was then depressed. This is an indication that the operator wishes to change the session time. If the time key was depressed, control proceeds to step 274 where the session time is displayed and to step 276 where the operator can change the desired session time. After the time has been changed in step 276 or if the time key was not depressed in step 272, control proceeds to step 278. In step 278 the microprocessor 100 determines whether the start key has been depressed to indicate that operation is to resume. If not, control proceeds to step 279 to determine if the programming mode key sequence has been depressed. Preferably the programming mode key sequence requires simultaneous depression of several keys to reduce chances of inadvertent programming. Programming allows the various stored parameters to be altered. If the sequence has not been depressed, control proceeds to step 270, while if it has, control proceeds to step 281, where the programming sequence 400 is executed. Control proceeds to step 280 after programming is complete. If the start key had been depressed, control proceeds to step 280 where the direction of the motor travel is reversed and motors 40, 44 and 48 are started. Control then proceeds to step 264 to display the dorsal/plantar angle for monitoring of operations. During most of the periods of program operation the microprocessor 100 is executing a motor operation sequence 300 (FIG. 6A). The motor operation sequence 300 is periodically interrupted by the timer interrupt sequence 250 to decrease the session time and to monitor the keyboard 62, but the remaining intervals are in the motor operation sequence 300. The initial step in the motor operation sequence 300 is step 302, where the initial motor voltages for the negative direction of travel are calculated. These voltages are developed based on the desired speeds and travel limts of the motors and the known motor characteristics. Control then proceeds to step 304 where the voltage values are applied to the D/A convertors 116, 118 and 120 so that the motors 40, 44 and 48 commence operation. Control then proceeds to step 306 to determine whether the slaved motors are within 1° of their desired location. In the preferred embodiment one motor is considered the reference or master, preferably the dorsal/plantar, with the valgus/varus and abduction/adduction motions being slaved to the dorsal/plantar so that a proper movement of the foot is maintained. By slaving the motors in this manner the movement of the ankle is within physical limits, thus reducing the chances of damage due to unsynchronized motions developing. Preferably the various directions have travel limits based on a particular angle positive and negative of a central reference. In the preferred embodiment the full travel of each direction in a given direction is considered full scale so that motors 40, 44 and 48 are driven such that each motion hits full desired travel at the same time for a given direction and then travel reverses until full travel is reached at the opposite desired limits simultaneously. Thus the various motor speeds are proportional to the reference or master motor and to the various ratios of angles of travel to be developed.

If the slave motors are not within 1°, the microprocessor 100 calculates new slave motor values based on the error difference and the present slave motor value and applies these values to cause the slave motors to respond properly. Control then proceeds to step 310. If the slave motors are within 1° control would proceed from step 306 to step 310.

In Step 310 the microprocessor 100 determines if the direction limit has been reached for that particular direction. If not, control proceeds to step 312 to determine if motors 40, 44 or 48 are in an overcurrent condition indicating a high load or force condition. If not, control proceeds to step 314 to determine if the motors are within a desired speed tolerance from that particular program. If so, control returns to step 306 to continue monitoring of the slave motor locations. If motors 40, 44 and 48 were not within speed tolerance as determined in step 314 or were overcurrent as determined in step 312, control proceeds to step 316 where new motor voltage values are developed to either correct the speed imbalance or reduce the current being delivered to the motors. Control then proceeds to step 306 to continue location monitoring.

Figure 6B:
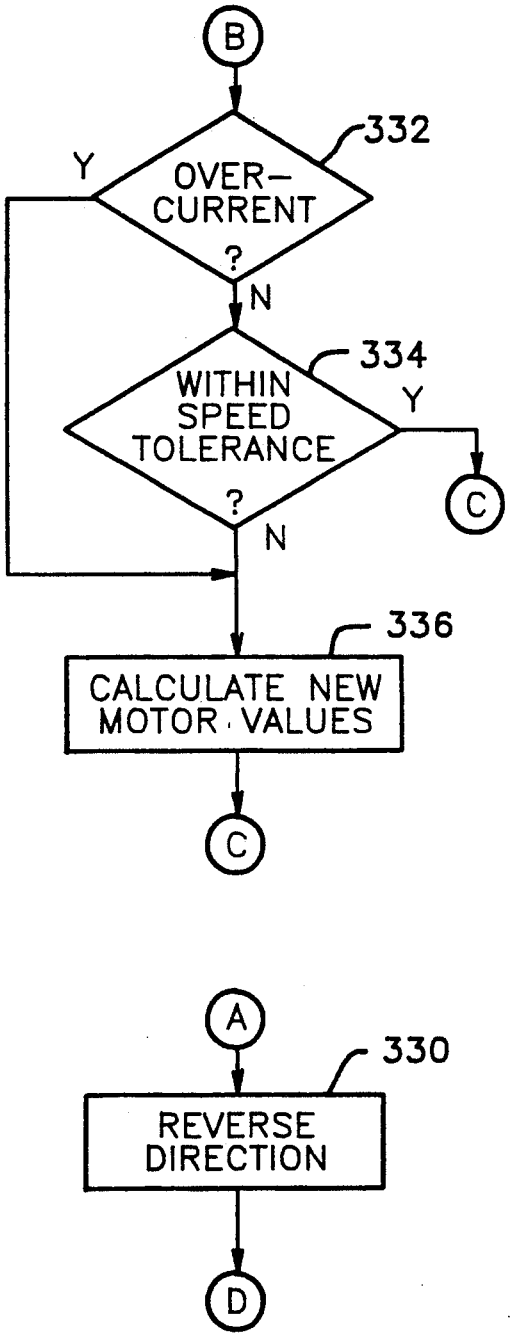

If the direction limit was reached as determined in step 310, control proceeds to step 320 where the direction of travel is reversed. Control proceeds to step 322 where the various voltages are recalculated and applied. Control then proceeds to step 324 to determine for this particular direction of travel if the slave motors are within 1° of the desired position. If not, control proceeds to step 326 where new slave motor values are calculated and applied. If the motors are within 1° or after calculation of new values in step 326, control proceeds to step 328 to determine if the direction limit has been reached in this particular direction. If so, control proceeds to step 330 (FIG. 6B) where the direction of travel is reversed. Control then proceeds to step 304 where voltages are applied to cause motors 40, 44 and 48 to move in the opposite direction. If the direction limit has not been reached, control proceeds to step 332 to determine if an overcurrent condition exists. If not, control proceeds to step 334 to determine if motors 40, 44 and 48 are within the desired speed tolerances. If not or if an overcurrent condition exists, control proceeds to step 336 where new motor values are calculated. Control then proceeds to step 324. If motors 40, 44 and 48 were within the speed tolerances, control proceeds from step 334 to step 324 to recheck position of the motors.

Thus it can be seen that a closed loop for monitoring motor operation is developed so that the motors 40, 44 and 48 are within force and speed limits as set by the therapist or operator and the slave motors are within a sufficient position, preferably 1°, of the master motor, so that the proper movement of the exerciser E is developed to limit improper motions of the joint. This operation continues according to the desired program until the session time is complete or it is otherwise stopped as indicated by the timer operation, such as an operator request.

Figure 7A:
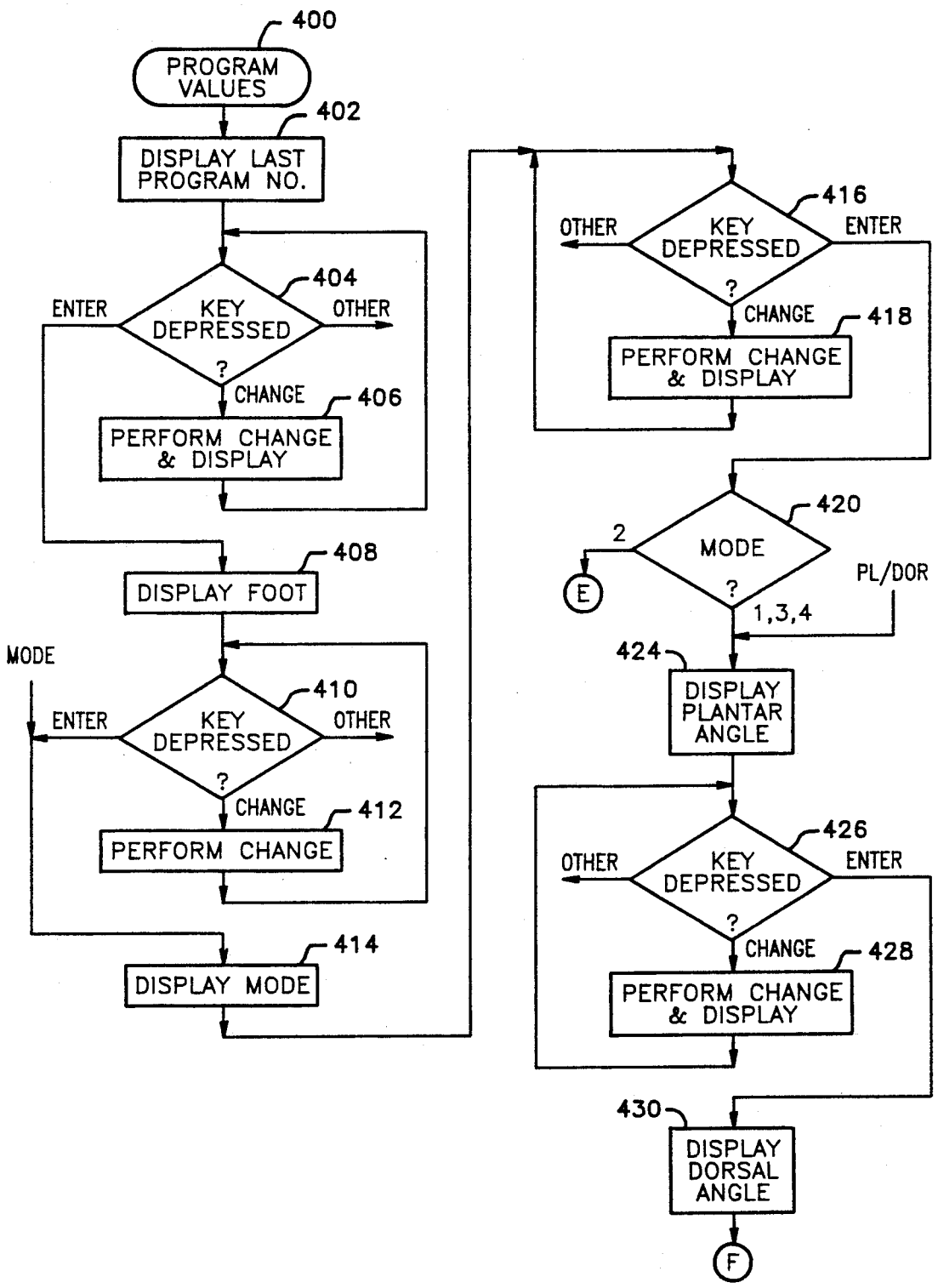

As indicated above, numerous program values and operations can exist in the exerciser E. It is often desirable to change these various programs which are preferably then stored in a battery backed-up or nonvolatile portion of the RAM 106. This condition is preferably entered by entering the multiple key sequence as mentioned in the timer interrupt sequence 250 description. The program sequence 400 (FIG. 7A) commences at step 402 where the last program number utilized is displayed. Control then proceeds to step 404 where a determination is made as to whether a key is depressed. If the change key, that is an arrow up or down key to increment or decrement the program number, has been pressed, control proceeds to step 406 where the program number is changed. The new number is displayed and control returns to step 404. If the enter key has been depressed, indicating that this is the desired program, control proceeds to step 408. If some other command key was depressed control transfers to that proper entry point. Exemplary other command keys are a mode key, which is used to indicate the particular mode of operation, that is, the number of axes generally being performed or the master motor; the PL/DOR key, which is to indicate the plantar/dorsal angle for the particular program; the speed key, which is used to set the various speed limits for the particular motor; the ADD/ABD key, which is used to set or display the adduction/abduction angle; the force key which is used to display and control the maximum force to be developed by any of the particular motors on the joint; and the VAR/-VAL key which is used to set or change the varus/valgus angle. In the flow chart in any of the particular queries regarding a key depression, if one exit to the particular step is to an other command key, control proceeds to the entry point being appropriately indicated in the flow charts as responding to that particular key.

If the enter key had been depressed in step 404, control proceeds to step 408 where the desired foot, that is left or right, is indicated in the display. Control proceeds to step 410 to determine if a key has been depressed. If it is the change key, control proceeds to step 412 where the change to the other foot is performed and displayed and control returns to step 410. If the enter key was depressed or the mode key was depressed, control proceeds to step 414. If one of the other command keys was depressed, control transfers to the appropriate entry point as will be described.

In step 414 the particular mode of operation is displayed. Mode 1 is a single axis mode where only plantar/dorsal movement occurs. Mode 2 in the preferred embodiment is a two axis movement, the relationships being varus and adduction to valgus and abduction. Mode 3 is a three axis movement, with the relationships being plantar, valgus and abduction to dorsal, varus and adduction. Mode 4, the final mode in the preferred embodiment, is also a three axis movement, plantar, varus and abduction to dorsal, valgus and adduction. The first named movement in modes 2, 3 and 4, namely varus/valgus and plantar/dorsal, is the master movement and the remaining motions are slaved.

Control proceeds from step 414 to step 416 to determine if another key has been depressed. If the change key has been depressed, indicating a change in the desired mode, control proceeds to step 416 where the mode value is incremented or decremented as appropriate and displayed. Control then returns to step 416. If the enter key was depressed, control proceeds to step 420. If one of the other command keys was depressed, control proceeds to the proper entry point.

Figure 7B:
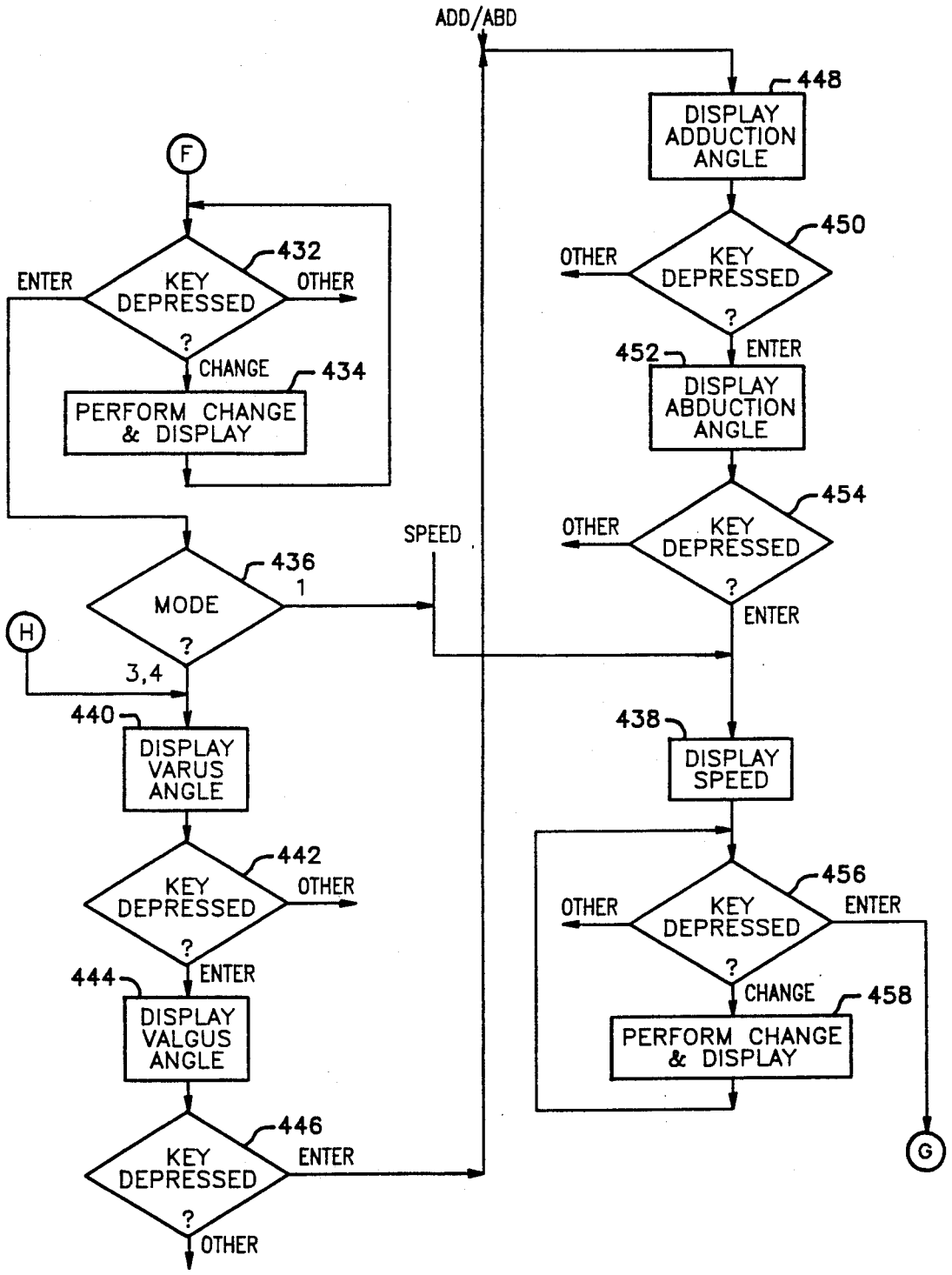
Figure 7C:
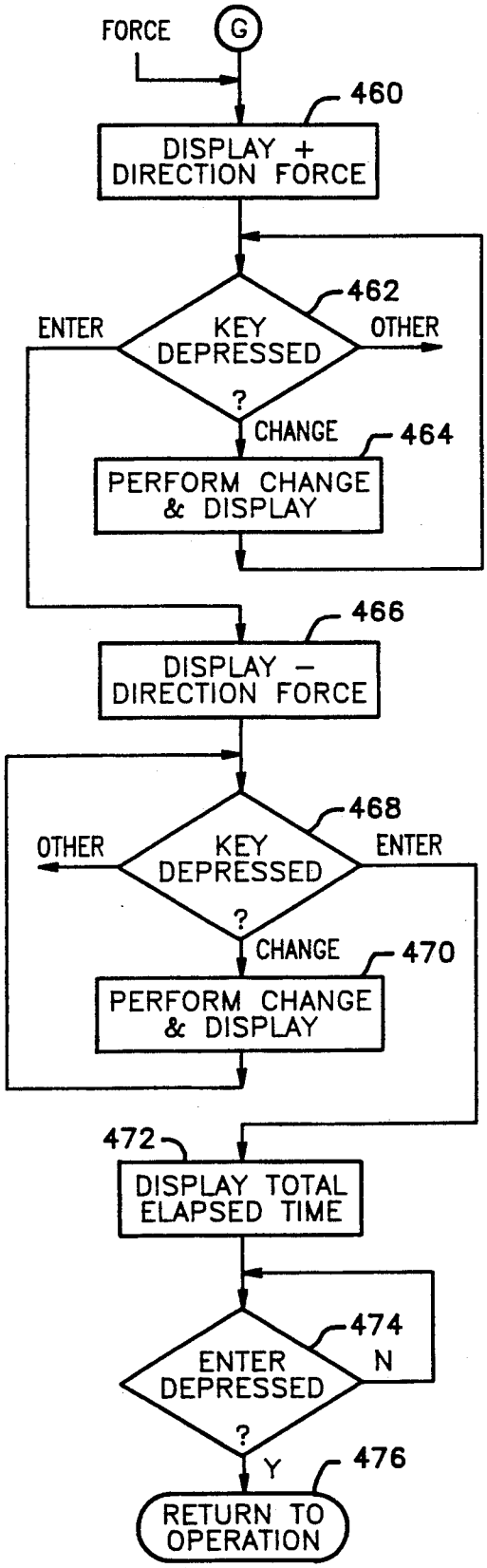
Figure 7D:
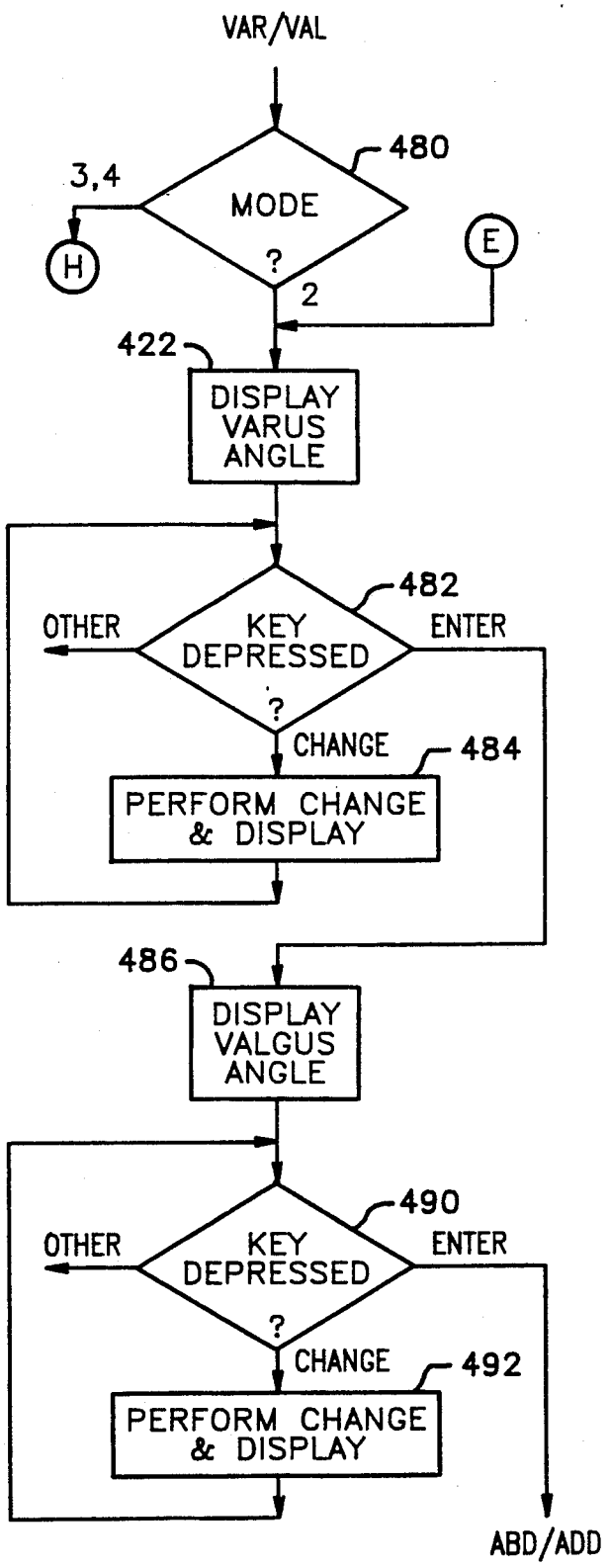

In step 420 the microprocessor 100 determines the particular mode value of operation. If the mode is a value of 2, control proceeds to step 422 (FIG. 7D). If the mode value is 1, 3 or 4, control proceeds to step 424 where the full travel plantar angle is displayed. After the full travel plantar angle has been displayed in step 424, control proceeds to step 426 to determine if a key has been depressed. If the change key has been depressed, indicating that the maximum plantar angle is to be changed, control proceeds to step 428 where the particular angle is changed and the new value displayed and control returns to step 426. If the enter key was depressed, this is an indication to that the operator wishes to proceed to setting the dorsal angle in step 430. If one of the other command keys were depressed, control proceeds to that entry point.

In step 430 the maximum dorsal angle for the particular program is displayed. After displaying the angle in step 430, control proceeds to step 432 (FIG. 7B) to determine if a key has been depressed. If the change key has been depressed, control proceeds to step 434 when the maximum dorsal angle of travel is changed and the new value displayed. Control returns to step 432. If the enter key has been depressed, control proceeds to step 436. If one of the other command keys has been depressed, control proceeds to that proper entry point.

In step 436 the microprocessor 100 reevaluates the mode. If the mode is 1, control proceeds to step 438. If the mode is 3 or 4, control proceeds to step 440 where the varus angle is displayed. Control then proceeds to step 442 to see if a key was depressed. If the enter key was depressed, control proceeds to step 444, while if one of the other command keys was depressed, control proceeds to that entry point. If a key other than enter or command was depressed control merely stays at step 442 waiting for one of the proper keys. In step 444 the valgus angle is displayed. Control then proceeds to step 446 to see if another key has been depressed. If the enter key has been depressed, control proceeds to step 448, which is also the entry point for the ADD/ABD or adduction/abduction command key. If one of the other command keys had been depressed, control proceeds to that entry point. Again if an improper key was depressed, control merely stays at step 446 until a proper key is depressed.

In step 448 the adduction angle is displayed. Adduction and abduction travel limits in all modes are set to values defined in the exerciser E because the relationships are predefined by the conditions and movements of the human body and therefore user entry or changing of these values is not desired. If the basic unit were adapted to be used on a different joint, such as the hip or shoulder, the entry point of the various angles could very well change, depending upon the particular motions and arrangement of the particular axes. After the adduction angle is displayed in step 448, control proceeds to step 450 to determine if a key had been depressed. If the enter key was depressed, control proceeds to step 452. If another allowable command key was depressed, control proceeds to that entry point. In step 452 the abduction angle is displayed. Control proceeds to step 454 to see if a key had been depressed. If the enter key was depressed, control proceeds to step 438. If an allowable command key was depressed, control proceeds to that entry point.

Step 438 is the entry point for the speed key and in that step the maximum speed of the motors is displayed. Control then proceeds to step 456 to determine if a key has been depressed. If the change key has been depressed, control proceeds to step 458 where the particular change in the value is performed and the new value displayed. Control returns to step 456. If the enter key has been depressed, control proceeds to step 460 (FIG. 7C). If one of the other allowable command keys has been depressed, control proceeds to that entry point.

Step 460 is also the entry point for the force command key and in step 460 the force value for the positive direction of travel is displayed. Control then proceeds to step 462 to determine if a key had been depressed. If the change key was depressed, the maximum force value for the positive direction is changed in step 464 as desired and the new value displayed. Control returns to step 462. If the enter key had been depressed, control proceeds to step 466. If one of the allowable command keys has been depressed, control proceeds to that entry point. In step 466 the maximum force to be applied in the negative direction of travel is displayed. Control proceeds to step 468 to determine if a new key had been depressed. If the change key was depressed, control proceeds to step 470 where the particular change of force value is performed and a new value displayed. Control then returns to step 468. If the enter key had been depressed, control proceeds to step 472. If one of the other command keys had been depressed, control proceeds to that entry point.

In step 472 the total amount of operating time is displayed. Control then proceeds to step 474 to determine if the enter key was depressed. If not, control loops at step 474. If so, control proceeds to step 476, which returns the operation of the exerciser E to the timer interrupt sequence 250.

If the VAR/VAL command key has been depressed, control proceeds to step 480 (FIG. 7D). In step 480 the microprocessor 100 determines the mode of operation. If the mode is mode 3 or 4, control proceeds to step 440 where the varus angle is displayed and cannot be changed. If the exerciser is set for mode 2, control proceeds to step 422 where the varus angle is displayed. Control then proceeds to step 482 to determine if a key had been depressed. If the change key was depressed, control proceeds to step 484 where the change operation is performed and the new value displayed. Control returns to step 482. If the enter key was depressed, control proceeds to step 486. If one of the other allowable command keys was depressed, control proceeds to that entry point.

In step 486 the valgus angle is displayed. Control then proceeds to step 490 to determine if a key has been depressed. If the change key was depressed in step 492, the microprocessor 100 performs the change of the valgus angle and displays the result. Control then returns to step 490. If the enter key was depressed, control proceeds to the ABD/ADD entry point. If one of the other allowable keys had been depressed, control proceeds to that entry point.

Thus it can be seen that the exerciser E allows programming of the particular master values, the speed of the motors and the particular maximum forces to be applied.

While this detailed description has elaborated on a hind foot exerciser and its appropriate motions, the same basic unit, including operational controls, could be used for other joints such as the hip and shoulder by appropriately modifying the cradles and motors.

The foregoing disclosure and description of the invention are illustrative and explanatory thereof, and various changes in the size, shape, materials, components, circuit elements, wiring connections and contacts, as well as in the details of the illustrated circuitry and construction may be made without departing from the spirit of the invention.

I claim:

1. A multiple axis passive motion exerciser, comprising:

means for receiving the portion of the patient to be moved, said receiving means being movable in at least two axes of movement of the joint of interest;

a first motor connected to said receiving means to cause said receiving means to move about a first axis;

a first feedback means connected to said receiving means to monitor the position of said receiving means about said first axis;

a second motor connected to said receiving means to cause said receiving means to move about a second axis;

a second feedback means connected to said receiving means to monitor the position of said receiving means about said second axis;

means connected to said first and second motors for providing drive energy to said motors; and means connected to said first and second position feedback means and to said motor drive means for controlling the activation of said first motor to move said receiving means about said first axis within first axis predetermined limits and for controlling the activation of said second motor to move said receiving means about said second axis within second axis predetermined limits and within a predetermined tolerance of a desired position defined by the relative position of said receiving means about said second axis within said second axis predetermined limits being equal to the relative position of said receiving means about said first axis within said first axis predetermined limits, so that said receiving means reaches substantially said first and second axes predetermined limits at substantially the same time.

2. The exerciser of claim 1, wherein said control means includes:

a microprocessor;

memory connected to said microprocessor for storing program instructions and data;

means connected to said microprocessor and said motor drive means for converting data provided by said microprocessor into motor drive control signals; and means connected to said microprocessor and said first and second position feedback means for converting position feedback information to data for provision to said microprocessor.

3. The exerciser of claim 2, further comprising:

means for monitoring drive currents of said first and second motors; and means connected to said microprocessor and said current monitoring means for converting current information to data for provision to said microprocessor.

4. The exerciser of claim 3, wherein said control means further controls the activation of said first and second motors to keep drive current levels below predetermined limits.

5. The exerciser of claim 2, wherein said control means further includes:

display means coupled to said microprocessor for displaying information to an operator; and keyboard means coupled to said microprocessor for transmitting operator commands to said microprocessor.

6. The exerciser of claim 5, wherein said control means further includes:

means coupled to said microprocessor and said keyboard means and responsive to commands from said keyboard for changing said first axis predetermined limits.

7. The exerciser of claim 6, wherein said control means further includes:

means coupled to said microprocessor, said keyboard and said display means and responsive to commands from said keyboard for displaying status information on selected items.

8. The exerciser of claim 1, wherein said receiving means includes:

a first portion being movable about a first axis of movement with respect to the joint of interest; and a second portion being movable about a second axis of movement with respect to the joint of interest, said second portion being rotatably coupled to said first portion.

9. The exerciser of claim 8, wherein one of said first and second motors and of said first and second position feedback means is connected to said first portion and the other of said first and second motors and of said first and second feedback means is connected to said second portion.

10. The exerciser of claim 8, wherein said second portion includes means for securably receiving the foot of the patient and wherein the axes of rotation of said first and second portions generally coincide with the axis of the ankle of the patient.

11. The exerciser of claim 1, further comprising:

a third motor connected to said receiving means to cause said receiving means to move about a third axis; and a third feedback means connected to said receiving means to monitor the position of said receiving means about said third axis; and wherein said drive means is further connected to said third motor to provide drive energy to said third motor, and wherein said control means is further connected to said third position feedback means and controls the activation of said third motor to move said receiving means about said third axis within third axis predetermined limits and within a predetermined tolerance of a desired position defined by the relative position of said receiving means about said third axis within said third axis predetermined limits being equal to the relative position of said receiving means about said first axis within said first axis predetermined limits, so that said receiving means reaches substantially said first and third axes predetermined limits at substantially the same time.

12. The exerciser of claim 11, wherein said control means includes:

a microprocessor;

memory connected to said microprocessor for storing program instructions and data;

means connected to said microprocessor and said motor drive means for converting data provided by said microprocessor into motor drive control signals; and means connected to said microprocessor and said first, second and third position feedback means for converting position feedback information to data for provision to said microprocessor.

13. The exerciser of claim 12, further comprising:

means for monitoring drive currents of said first, second and third motors; and means connected to said microprocessor and said current monitoring means for converting current information to data for provision to said microprocessor.

14. The exerciser of claim 13, wherein said control means further controls the activation of said first and second motors to keep drive current levels below predetermined limits.

15. The exerciser of claim 12, wherein said control means further includes:

display means coupled to said microprocessor for displaying information to an operator; and keyboard means coupled to said microprocessor for transmitting operator commands to said microprocessor.

16. The exerciser of claim 15, wherein said control means further includes:

mean coupled to said microprocessor and said keyboard means and responsive to commands from said keyboard means for changing said first axis predetermined limits.

17. The exerciser of claim 16, wherein said control means further includes:

means coupled to said microprocessor, said keyboard means and said display means and responsive to commands from said keyboard means for displaying status information on selected items.

18. The exerciser of claim 11, wherein said receiving means includes:

a first portion being movable about a first axis of movement with respect to the joint of interest;

a second portion being movable about a second axis of movement with respect to the joint of interest, said second portion being rotatably coupled to said first portion; and a third portion being movable about a third axis of movement with respect to the joint of interest, said third portion being rotatably coupled to said second portion.

19. The exerciser of claim 18, wherein one of said first, second and third motors and of said first, second and third position feedback means is connected to said first portion, a different one of said first, second and third motors and of said first, second and third position feedback means is connected to said second portion and the remaining of said first, second and third motors and of said first, second and third feedback means is connected to said third portion.

20. The exerciser of claim 18, wherein said third portion includes means for securably receiving the foot of the patient and wherein the axes of rotation of said first, second and third portions generally coincide with the axis of the ankle of the patient.

* * * * *